United States Patent [19]

Hill

[11] 3,940,815

[45] Mar. 2, 1976

[54] QUICK FOOT RELEASE FOR SWIM FIN

[75] Inventor: James E. Hill, Bremerton, Wash.

[73] Assignee: Imperial Manufacturing Company, Bremerton, Wash.

[22] Filed: May 15, 1974

[21] Appl. No.: 470,209

Related U.S. Application Data

[63] Continuation of Ser. No. 356,784, May 3, 1973, abandoned.

[52] U.S. Cl. ..... 9/309

[51] Int. Cl.[2] ..... A63B 31/08

[58] Field of Search ..... 9/301, 304, 305, 306, 309, 9/310 AA; 36/2.5 B, 2.5 Y, 2.5 W, 50 X

[56] References Cited

UNITED STATES PATENTS

| | | | |
|---|---|---|---|
| 139,109 | 5/1873 | Boch | 36/50 X |
| 2,779,077 | 1/1957 | Kline | 9/309 |

FOREIGN PATENTS OR APPLICATIONS

| | | | |
|---|---|---|---|
| 1,223,430 | 6/1960 | France | 9/309 |

*Primary Examiner*—Trygve M. Blix
*Assistant Examiner*—Stuart M. Goldstein
*Attorney, Agent, or Firm*—Wegner, Stellman, McCord, Wiles & Wood

[57] ABSTRACT

A swim fin including a quick-release mechanism associated with the heel strap. The quick-release mechanism includes a lever and a link which are secured together and to the strap in such a way as to define an over center, toggle, lever arrangement whereby the effective length of the strap can be quickly and abruptly changed to allow easy entry or release of the foot of a swimmer from the foot receiving cavity of the fin.

1 Claim, 4 Drawing Figures

10
12
14
16
18
20
22
24
26
28
30
32
34
36
38
42
44
46
48
50
54
56
58
60
62
64
66
3.
3.

QUICK FOOT RELEASE FOR SWIM FIN

This is a continuation of application Ser. No. 356,784 filed May 3, 1973, now abandoned.

BACKGROUND OF THE INVENTION

This invention relates to swim fins, and more particularly, to a quick-release device associated with the foot retaining strap on a swim fin.

Recent years have seen an explosion in a variety of recreational fields including swimming with the use of snorkels and/or scuba gear. Typically swimmers indulging in such endeavors utilize swim fins for increased and more effortless propulsion through the water. As every such swimmer knows, swim fins are a substantial advantage while in the water and swimming, but because of their bulk and unwieldyness, are cumbersome when the swimmer is entering or exiting the water or attempting to move out on land.

Thus, the swimmer will normally attempt to place the swim fin on his foot or remove it at or about the time of entry or exit into the water so as to avoid mobility difficulties caused by the bulk and unwieldyness of the fin. This procedure, however, has been less than satisfactory because of the securing means normally employed in connection with swim fins for holding the same on a swimmer's foot. Typically, such means are in the form of a strap extending across the opening of a foot receiving cavity in the fin to engage the heel of the swimmer and hold the foot in the cavity. Because the losing of a fin while swimming is to be avoided, such straps are normally placed under a fair amount of tension which makes it difficult to place the foot in the fin or remove the foot from the fin. As a result, it is almost as much bother for a swimmer to put on or take off a fin as it is to attempt to enter or exit the water or move about on dry land while wearing the fin.

SUMMARY OF THE INVENTION

It is the principal object of the invention to provide a new and improve swim fin. More particularly, it is an object of the invention to provide a swim fin that may be easily placed on the foot of a swimmer or taken off the foot of a swimmer.

The exemplary embodiment of the invention achieves the foregoing object in a construction including a swim fin having a foot receiving cavity having an opening for receiving the foot of the swimmer adjacent the heel of the fin, an opposed toe end and a flexible blade extending forwardly and integral with the toe. A strap is secured to the foot receiving portion of the fin adjacent the opening on one side thereof while a quick-release connection is located between the other end of the strap and the foot receiving portion on an opposite side of the foot receiving opening.

According to the preferred embodiment, the quick-release connection is of a type whereby, through a single operation of the swimmer, the effective length of the strap may be quickly and substantially changed from a relatively short effective length whereat the strap will tightly embrace the swimmer's heel to hold the fin securely on the swimmer's foot and a relatively longer effective length whereat the strap will not interfere with the entry or exit of the swimmer's foot into or out of the foot receiving cavity.

One preferred construction of a quick-release means according to the invention is the use of an over center, toggle lever arrangement. According to the preferred embodiment, the lever is pivotally mounted to the foot receiving portion of the swim fin while a link extends from a point intermediate the ends of the lever to the strap. The arrangement is such that when an end of the lever opposite its point of pivotal connection to the foot receiving portion is extended directly away from the heel opening, a relatively short effective length of the strap results. The over center construction of the link and lever will hold the same in such a configuration once it has been manually moved thereto. When the swimmer desires to release his foot from the fin, the lever is merely pivoted toward the heel receiving opening to vastly increase the effective length of the strap whereby the foot may be easily removed or inserted out of or into the foot receiving cavity.

Other objects and advantages of the invention will become apparent from the following specification taken in conjunction with the accompanying drawings.

DESCRIPTION OF THE PREFERRED EMBODIMENT

Figures 1, 2, 3, 4:
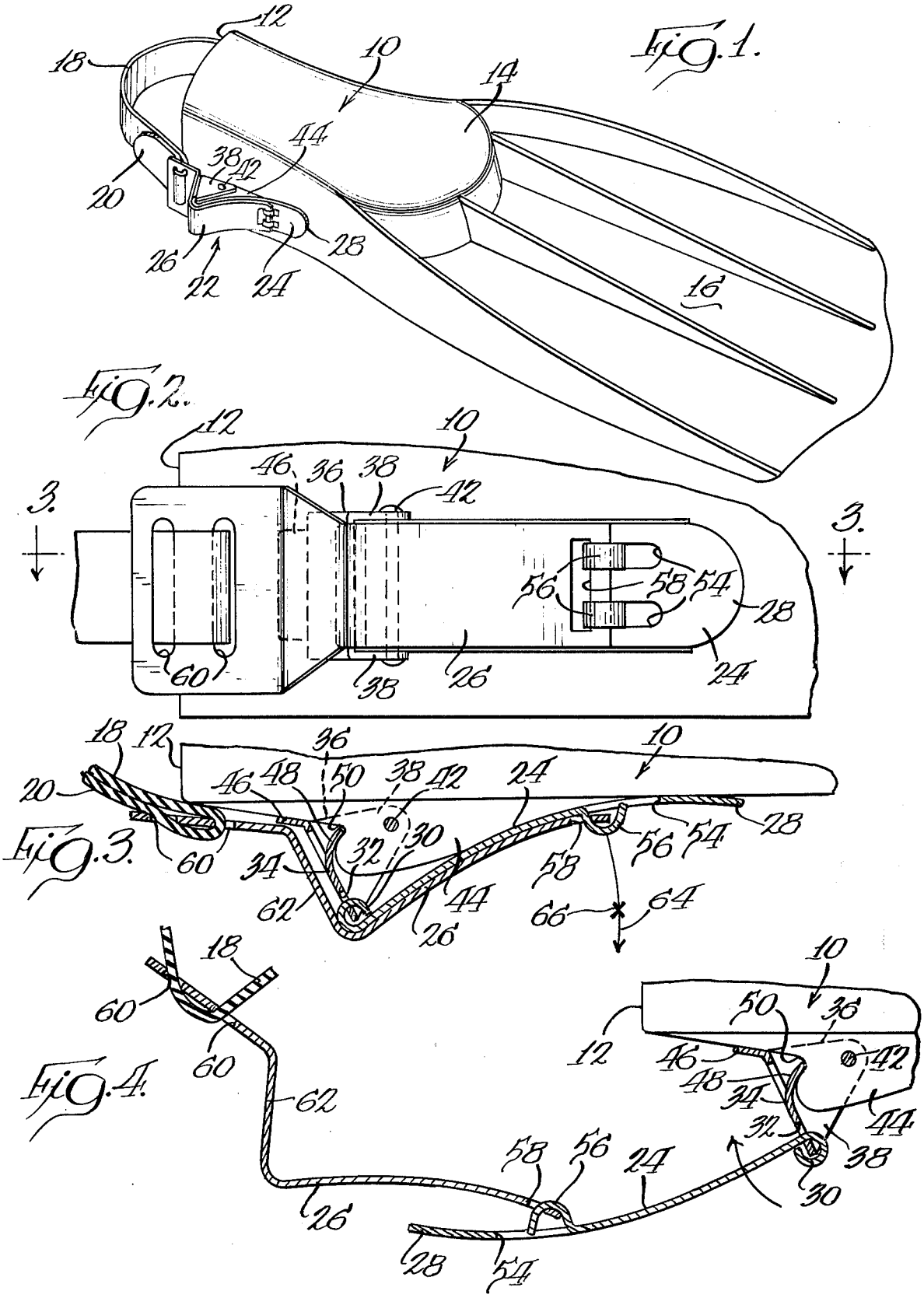
FIG. 1 is a perspective view of a swim fin embodying the invention.
FIG. 2 is an enlarged, fragmentary, side elevation of a quick-release connection employed in the swim fin.
FIG. 3 is a horizontal section taken approximately along the line 3—3 of FIG. 2 and illustrates the arrangement of the elements when the strap has a relatively short effective length.
FIG. 4 is a view similar to FIG. 3 but illustrating the arrangement of the various elements when the strap has a relatively long effective length.

An exemplary embodiment of a swim fin embodying the invention is illustrated in FIG. 1 and is seen to include a hollow, foot receiving portion, generally designated 10, having an open end 12 whereby the foot of a swimmer may be inserted into the foot receiving portion 10. Opposite of the opening 12 is a closed toe 14 and extending forwardly of the toe 14 and integral therewith is a flexible blade 16 as is well known.

Extending across the opening 12 is a strap 18 having one end (not shown) fixedly secured to the foot receiving portion 10 adjacent one side of the opening 12 by any conventional means known in the art. The other end 20 of the strap 18 is secured to a quick-release means, generally designated 22, whereby the effective length of the strap 18 may be selectively and abruptly changed between a relatively short effective length whereat the strap 18 will tightly embrace the heel of a swimmer having his foot within the foot receiving portion 10 and a relatively long effective length whereat the foot may be easily placed into the foot receiving cavity or removed therefrom without interference from the strap 18. The quick-release means 22 are fixedly secured by means to be described in greater detail hereinafter to the foot receiving portion 10 adjacent the side of the opening 12 and opposite from the point of attachment of the other end of the strap 18.

With reference now to FIGS. 1–4, inclusive, the quick-release means 22 will be described in greater detail. The basic components of the same include a lever 24 and a link 26. As seen in the various FIGS., the right-hand end 28 of the lever 24 serves as a handle portion. As will be seen, the user of the fin may grasp the handle portion 28 to selectively operate the quick-release means 22 in a manner to be described in greater detail hereinafter.

Turning now to FIGS. 2–4, inclusive, the lever 24, at the end opposite the handle portion 28, includes a re-entrant loop 30. The loop 30 is passed through a slot 32 in the bight 34 of a U-shaped mounting bracket 36. The legs 38 of the U-shaped mounting bracket include aligned apertures 40 near their extremities for receipt of a securing pin 42. Adjacent the opening 12 and on the exterior of the foot receiving portion 10, is an integral lug 44 about which the U-shaped bracket 36 is located, as best seen in FIGS. 2–4. The pin 42 is then passed through the apertures 40 and a bore (not shown) in the lug 44 to firmly captivate the U-shaped member 36.

It is also to be observed that the bight 34 of the U-shaped bracket 36 includes a depending flange 46 as well as an inwardly directed tongue 48. The flange 46 bears against the exterior of the foot receiving portion 10 while the tongue 48 bears against a small notch 50 formed in the lug 44 so that the U-shaped bracket 36 bears against the fin at two spaced points to substantially preclude relative movement between the two thereby minimizing wear on the relatively soft material of which the swim fin will normally be formed.

As a result of the foregoing construction, it will be appreciated that the lever 24 is pivotally mounted on the foot receiving portion 10 adjacent the opening 12 with the U-shaped bracket 38 serving to locate the pivot axis of the lever 24 outwardly a distance from the foot receiving portion 10.

Intermediate the ends of the lever 24, the latter includes a pair of U-shaped openings 54. As a result of the provision of the U-shaped openings 54, a pair of tongues are defined and they, in turn, are passed through a slot 58 in the end of the link 26 remote 56 are the opening 12 in such a way as to captivate the end of the link and define a pivotal connection between the link 26 and the lever 24.

The end of the link 26 remote from the lever 24 includes a pair of slots 60 for receiving the end 20 of the strap 18 to firmly, but adjustably, connect the end of the link 26 to the strap 18.

Intermediate the ends of the link, the latter includes a V-shaped formation 62 which, as viewed in FIG. 3, allows the link 26 to pass about the pivotally mounted end of the lever 24. This formation allows the end of the link 26 to which the strap 18 is connected, to be closely adjacent the exterior of the foot receiving portion 10, as well as to allow the opposite end of the link 26 to assume a position in substantial abutment with the lever 24 in one position of the relative movement thereof.

As can be seen in FIG. 3, an over center, toggle lever arrangement is defined. When the lever 24 is moved to the position illustrated in FIG. 3, it will be appreciated that the strap end 20 will be drawn close to the opening 12 thereby providing a relatively short effective length of the strap 18. By suitably orienting the strap 18 within the slots 60, any desired foot retaining tension may be applied to the strap 18.

When it is desired to increase the effective length of the strap 18, the handle portion 28 of the lever 24 may be grasped and the same moved in the direction of an arrow 64, as shown in FIG. 3. At about a point 66, the lever 24 will pass over center and release so that the lever 24 and the link 26 may assume the position illustrated in FIG. 4. As is readily apparent, the effective length of the strap 18 has then been vastly increased so that a foot may be placed into or removed from the foot receiving cavity 10 with relative ease. Thus, at no time, need a simmer struggle with a tensioned strap in the course of putting on or taking off a swim fin. With the quick-release means of the invention, the swimmer need only simply and easily manipulate the lever 24 through the handle portion 28 thereof.

I claim:

1. A swim fin comprising: means defining a hollow, foot receiving portion having a heel opening whereby a swimmer may insert a foot into said hollow foot receiving portion, and an opposed toe portion; a flexible blade extending forwardly of and integral with said toe portion; a flexible strap adapted to bear against the heel of a swimmer when the swimmer has his foot received in said hollow foot receiving portion, said strap having one end secured to said foot receiving portion adjacent said heel opening; means secured to said foot receiving portion adjacent said heel opening at a point opposite said strap one end for quickly releasing said strap, said means comprises a lever having one end pivotally secured to said foot receiving portion, a handle portion on said lever projecting away from said pivotally secured end, a link having one end pivotally connected to said lever intermediate the ends of said lever, the other end of said link being secured to said strap other end, said link includes a V-shaped formation intermediate its ends to allow a portion of said link to pass about said one end of said lever and move into substantial abutment with a portion of said lever, and means for holding said lever in a position wherein said handle portion is directed away from said heel receiving opening, said holding means includes means locating said lever one end substantially outwardly of said foot receiving portion so that said lever and said link define an overcenter toggle system, said locating means comprises a bracket secured to a lug on the exterior of said foot receiving portion, said bracket having first and second tabs bearing against said foot receiving portion at spaced locations.

* * * * *